US006452558B1

(12) United States Patent
Saitou et al.

(10) Patent No.: US 6,452,558 B1
(45) Date of Patent: Sep. 17, 2002

(54) ANTENNA APPARATUS AND A PORTABLE WIRELESS COMMUNICATION APPARATUS

(75) Inventors: Yutaka Saitou, Ishikawa-ken; Tomoaki Nishikido, Kanazawa; Hiroshi Haruki, Yokohama, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/768,254

(22) Filed: Jan. 25, 2001

(30) Foreign Application Priority Data

Aug. 23, 2000 (JP) ..... 2000-252071

(51) Int. Cl.[7] ..... H01Q 21/00

(52) U.S. Cl. ..... 343/725; 343/700 MS; 343/702; 343/893

(58) Field of Search ..... 343/700 MS, 702, 343/725, 729, 829, 846, 872, 895, 900, 893

(56) References Cited

U.S. PATENT DOCUMENTS 5,204,687 A 4/1993 Elliott et al. ..... 343/702
5,598,169 A * 1/1997 Drabeck et al. ..... 343/701
6,166,694 A * 12/2000 Ying ..... 343/702
6,211,830 B1 * 4/2001 Monma et al. ..... 343/702
6,225,951 B1 * 5/2001 Holshouser et al. . 343/700 MS
6,252,554 B1 * 6/2001 Isohatala et al. ..... 343/700 MS
6,255,994 B1 * 7/2001 Saito ..... 343/700 MS

FOREIGN PATENT DOCUMENTS

JP 57-103406 6/1982 ..... H01Q/13/18

* cited by examiner

*Primary Examiner*—Don Wong
*Assistant Examiner*—Shih-Chao Chen
(74) *Attorney, Agent, or Firm*—Parkhurst & Wendel, LLP

(57) ABSTRACT

A microstrip antenna (MSA) above a ground plane, having a size corresponding to an operation frequency, at a junction point thereof, electrically connected to one end of a monopole antenna having a size corresponding to the operation frequency to operate as a complex antenna. A distance between the feed point of MSA and the junction point determines the input impedance for matching. A microstrip line or an (planer) inverted-F antenna may provide the MSA. The monopole element may be a monopole antenna or helical antenna. A portable wireless communication apparatus includes the antenna apparatus having a housing. The monopole antenna is connected to the MSA when the monopole antenna is extended from the housing. A switch may be provided between the monopole antenna and the MSA for diversity operation. The antenna apparatus may be formed on a Printed circuit board and folded.

40 Claims, 15 Drawing Sheets

ANTENNA APPARATUS AND A PORTABLE WIRELESS COMMUNICATION APPARATUS

BACKGROUND OF THE INVENTION

1. Field of the Invention

This invention relates to an antenna apparatus and a portable wireless communication apparatus.

2. Description of the Prior Art

An antenna apparatus including a microstrip antenna is known and a portable wireless communication apparatus including the antenna apparatus including a microstrip antenna is also known.

In a portable wireless communication apparatus (a mobile or base station) of a semi-microwave band, a microstrip antenna or a monopole antenna is used. The microstrip antenna includes a square or a circular planer element above a ground plane at a constant interval. The length of the planer element is generally a half wavelength (referred to as a half wavelength microstrip antenna). This half wavelength microstrip line antenna has directivity in the direction perpendicular to the plane of the microstrip line. The main polarizing direction is single and corresponds to the edge of the microstrip line of which length is a half wavelength.

The monopole antenna apparatus includes a monopole antenna (linear element) arranged perpendicularly to an edge of the ground plane. This monopole antenna is fed in an unbalanced condition with respect to the ground plane. The length of the monopole antenna is generally a half wavelength or a quarter wavelength. The main polarizing direction is single and corresponds to an axial direction of the monopole antenna.

FIG. 17 is a perspective view of a monopole antenna of a prior art. This monopole antenna apparatus includes a monopole antenna 1 connected to a matching circuit 19 on a ground plane 6. The feed point impedance of the monopole antenna 1 is made 50 Ω by the matching circuit 19.

FIG. 18 is a graphical drawing showing prior art directivity of the monopole antenna shown in FIG. 17 on the XZ plane. The solid line represents the vertical polarizing component 20 and the chain line represents the horizontal polarizing component 21.

As shown in FIG. 18, the average level of the vertical polarizing component 20 is extremely higher that of the horizontal polarizing component 21 and has a directivity of letter "8". As mentioned above, the microstrip antenna apparatus has the single main polarizing direction same as the monopole antenna apparatus has.

Another prior art antenna apparatus included in a portable wireless communication apparatus is disclosed in Japanese patent application provisional publication No. 57-103406. In this document, adjusting the offset distance of the feed point provides the desired input impedance.

FIG. 19 is such a prior antenna apparatus of which feed point is offset to provide the desired input impedance. This antenna apparatus is called a planer inverted-F antenna. In the planer inverted-F antenna, the corner of the plate conductor of the inverted-F antenna 2 is connected to the ground plane 6 and the feed portion 4 is connected a point of the plate conductor which is offset from the grounding point to obtain the desired input impedance. When the planer inverted-F antenna is viewed from the external on the plane of the ground plane, there is an outline of the letter "F". Thus, this type of the antenna apparatus is called (planer) inverted-F antenna.

FIG. 20 is a graphical drawing showing the directivity of the prior art planer inverted-F antenna. In FIG. 20, the solid line represents the vertical polarizing component 22 and the chain line represents the horizontal polarizing component 23. In this planer inverted-F antenna apparatus, the level of the horizontal polarizing component 23 is slightly higher than that of the vertical polarizing component 22.

Estimating the characteristic of the antenna apparatus uses a pattern averaged gain (PAG) on the horizontal plane when a human being carries the portable wireless communication apparatus.

The PAG is given by equation (1) in the condition that the head of the human being holding the portable wireless communication including the antenna apparatus is positioned at the origin of the XYZ axes in Z direction .

$$PAG = \frac{1}{2\pi}\int_{2\pi}^{1}\left[G_\theta(\phi) + \frac{G_\phi(\phi)}{XPR}\right]d\phi \tag{1}$$

In Eq. (1), G θ (ϕ) and G ϕ (ϕ) represent power directivities of the vertical polarizing component and the horizontal polarizing component on the horizontal plane (XY plane), respectively. XPR represents a crossing polarizing power ratio, that is, a power ratio of the vertical polarizing components to the horizontal polarizing component. Generally, the general crossing polarizing power ratio XPR in the multi-path condition in the mobile communication is from 4 to 9 dB.

The PAG will be further described with assumption that the XPR is 9 dB.

FIGS. 21A to 21C are prior art illustrations showing using conditions of a portable wireless communication apparatus. FIG. 21A shows a portable wireless communication apparatus being used. FIG. 21B shows an enlarged side view of the portion A in FIG. 21. FIG. 21C shows an enlarged front view of the portion A. As shown in FIGS. 21A to 21C, the portable wireless communication is used at the position that the longitudinal direction is inclined by 60°. The PAG in this talking position provides the actual estimation index.

The prior art microstrip antenna apparatus and the monopole antenna apparatus cannot emit combined polarizing waves, that is, the polarizing direction is single. Thus, if the portable wireless communication apparatus is used with inclination, the main polarizing direction is also inclined, so that the actual PAG was insufficient. Moreover, the feed point impedance was high, so that the prior art antenna apparatus required a matching circuit to obtain the general input impedance of 50 Ω.

Moreover, in the prior art planer inverted-F antenna apparatus, an antenna current was distributed on the ground plane of the portable wireless communication apparatus, so that if the portable wireless communication apparatus is held by the hand or if it is placed on a metal table or the like, the radiation characteristic largely decreased. Thus, the actual PAG during communication was low.

SUMMARY OF THE INVENTION

The aim of the present invention is to provide a superior antenna apparatus and a superior portable wireless communication apparatus.

According to the present invention, a first aspect of the present invention provides an antenna apparatus comprising: a microstrip antenna above a ground plane, having a size corresponding to an operation frequency of said antenna apparatus; and a monopole element having a length corresponding to said operation frequency, one end of said monopole element being electrically connected to a point of said planer microstrip antenna, said microstrip antenna having a feed point at a predetermined distance from said point.

A second aspect of the present invention provides an antenna apparatus based on the first aspect, wherein said microstrip antenna comprises an inverted-F antenna including a short conductor for grounding at a distance from said feed point on the opposite side of said point.

A third aspect of the present invention provides an antenna apparatus based on the first aspect, wherein said microstrip antenna comprises a planer inverted-F antenna including a short conductor for grounding at a distance from said feed point on the opposite side of said point.

A fourth aspect of the present invention provides an antenna apparatus based on the first aspect, wherein said size is a half wavelength.

A fifth aspect of the present invention provides an antenna apparatus based on the first aspect, wherein said monopole element comprises a monopole antenna.

A sixth aspect of the present invention based on the fifth aspect provides an antenna apparatus further comprising: slidingly supporting means for slidingly supporting said monopole antenna; switch means; and a housing having a through hole and containing said inverted-F antenna, said monopole antenna, and said switch means and slidingly supporting means, wherein said switch electrically connects said one end to said point when said monopole antenna is extended from said housing through said through hole with said slidingly supporting means and electrically disconnecting said one end from said point when said monopole antenna is substantially contained in said housing with said slidingly supporting means.

A seventh aspect of the present invention based on said fifth aspect provides an antenna apparatus further comprising: slidingly supporting means for slidingly supporting said monopole antenna; switch means; and a housing having a through hole and containing said inverted-F antenna, said monopole antenna, and said switch means and slidingly supporting means, wherein said switch electrically connects said one end to said point when said monopole antenna is extended from said housing through said through hole with said slidingly supporting means and electrically connecting the other end of said monopole antenna when said monopole antenna is substantially contained in said housing with said slidingly supporting means.

An eighth aspect of the present invention based on said fifth aspect provides an antenna apparatus further comprising: switch means for electrically connecting and disconnecting said one end to and from said point to provide diversity operation between said inverted-F antenna and a complex antenna including said inverted-F antenna and the monopole antenna in response to a switch control signal.

A ninth aspect of the present invention based on said eighth aspect provides an antenna apparatus further comprising: communication condition detection means for detecting a communication condition using said antenna apparatus for generating said switch control signal in accordance with said communication condition.

A tenth aspect of the present invention based on said fifth aspect provides an antenna apparatus further comprising: a printed circuit board having a printed pattern for coupling said point to said one end.

An eleventh aspect of the present invention based on said fifth aspect provides an antenna apparatus, wherein said ground plane has substantially a right angle corner, said monopole antenna having a first portion which is in parallel to a first edge of said right angle corner and a second portion which is in parallel to a second edge of said right angle corner.

A twelfth aspect of the present invention based on said fifth aspect provides an antenna apparatus further comprising: a printed circuit board, wherein said monopole antenna is formed on said printed circuit board.

A thirteenth aspect of the present invention provides an antenna apparatus on said first aspect, wherein said monopole element comprises a helical antenna.

A fourteenth aspect of the present invention provides an antenna apparatus based on the first aspect, wherein a position of said feed point is determined by a distance from a zero voltage point at the microstrip antenna.

A fifteenth aspect of the present invention provides a portable wireless communication apparatus according to the above-mentioned aspects.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

<First Embodiment>

An antenna apparatus according to a first embodiment will be described with reference to FIGS. 1 to 8. In this embodiment, it is assumed that the operation frequency of the antenna apparatus is 2 GHz.

Figure 1:
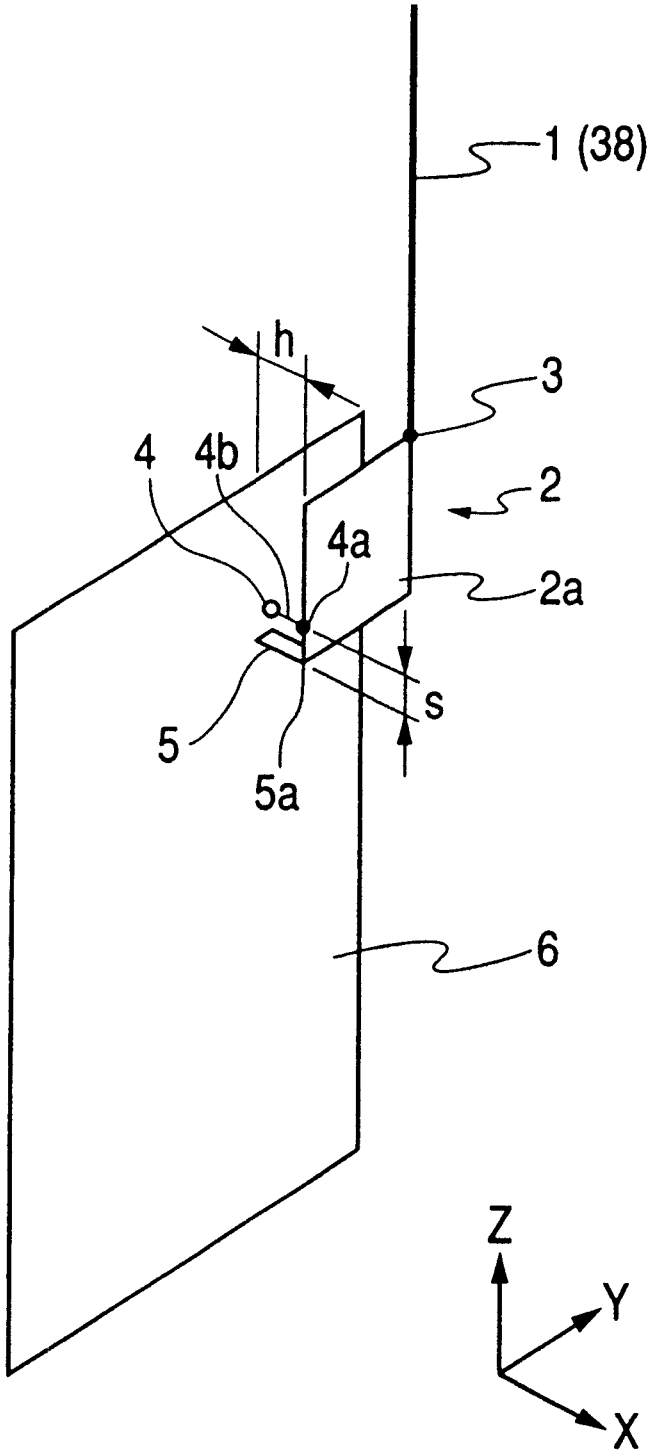
FIG. 1 is a perspective view of an antenna apparatus of a first embodiment.

FIG. 1 is a perspective view of the antenna apparatus of the first embodiment. A monopole 1 has a half wavelength (75 mm) at the operation frequency and acts as a monopole element protruding from a portable wireless communication apparatus.

One end of the monopole 1 is electrically connected to a connecting point 3 at a corner of the square conductor plate 2*a* diagonally opposite the corner where the shorting portion 5 is located. Then, the monopole 1 and the plate antenna 2 form the complex antenna, wherein both the monopole 1 and the plate antenna 2 are excited at the single feed point 4*a*.

Figure 2A:
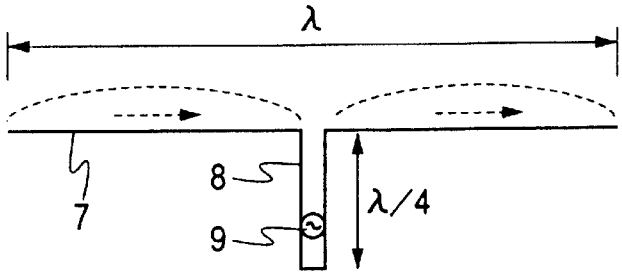
FIG. 2A PRIOR ART
FIG. 2A is an illustration of a prior art one-wavelength dipole.

The operation of the antenna apparatus shown in FIG. 1 will be described with reference to FIGS. 2A to 2C. FIG. 2A shows a one-wavelength dipole 7 as an example. The feed point of the one-wavelength dipole 7 is connected to a quarter wavelength-matching stub 8. The feed point impedance of the one wavelength dipole 7 is hundreds ohms, which is relatively high. The quarter wavelength matching stub 8 acts as a matching circuit for matching the impedance of the one-wavelength dipole 7 to provide a desired feeding impedance of 50 ϕ for example at the suitable feed point 9 of the quarter wavelength matching stub 8. The current distribution of the one-wavelength dipole 7 is shown by the chain lines and arrows in FIG. 2A.

Figure 2B:
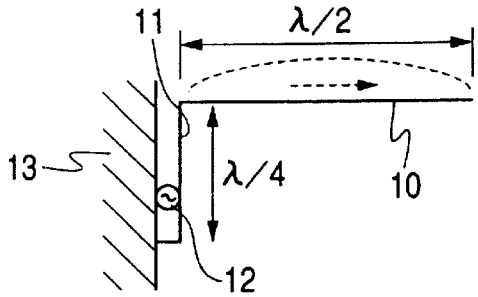
FIGS. 2B and 2C are explanatory illustrations of the antenna apparatus according to the first embodiment.

FIG. 2B shows a structure derived by replacing the left side portion of the one-wavelength dipole 7 shown in FIG. 2A with a ground plane 13. A monopole 10 has a half wavelength. The quarter wavelength-matching stub 11 corresponds to one side portion of the quarter wavelength-matching stub 8. The current distribution is shown by the chain line and the arrow in FIG. 2B. Then, the quarter wavelength-matching stub 11 is considered as the inverted-F antenna arranged above the ground plate.

Figure 2C:
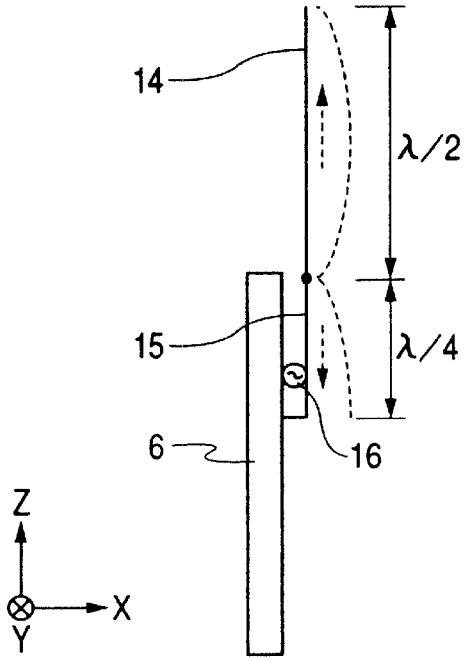

FIG. 2C shows the structure derived by arranging the monopole straightly extending from the quarter wavelength matching stub 15. In FIG. 2C, the inverted-F antenna 15 is arranged on the ground plane 6 and the direction of the monopole 14 is the same as that of the inverted-F antenna 15. The current distribution in this case is shown by chain lines and arrows in FIG. 2C. That is, the monopole 14 and the inverted-F antenna 15 operate as a complex antenna excited by a signal feed point 16. Here, the inverted-F antenna 15 operates as a matching circuit for the monopole 14, as well as operates as a portion of an emission element it self. Thus, no additional matching circuit is unnecessary. Moreover, this complex antenna shows radiation directivity which is different from that obtained by only monopole 14 or that obtained by only the inverted-F antenna 15.

Moreover, the inverted-F antenna 15 is formed with bars or line conductors. However, a planer inverted-F antenna or a microstrip antenna shows the similar feature by connecting the monopole antenna 14 to the point of the planer inverted-F antenna where the impedance is high (a corner).

In FIG. 2C, replacing the inverted-F antenna 15 with a planer inverted-F antenna provides the antenna apparatus shown in FIG. 1. As shown in FIG. 1, the highest impedance at the planer inverted-F antenna 2 is the junction point 3 to which the monopole antenna 1 is connected.

Adjusting the distance s between the feed point 4*a* and the shorting portion 5 provides impedance matching of the planer inverted-F antenna 2. That is, the distance s is determined to make the impedance of the planer inverted-F antenna 2 at the feed point 4*a* 50 ϕ. Then, if the monopole antenna 1 is connected to the junction point 3, the impedance at the feeding point 4*a* does not largely change because impedances of the planer inverted-F antenna 2 and the monopole antenna 2 at the junction point 3 are mutually high. In fact, the distance s is finely adjusted in the range of about 1 mm to provide the impedance of 50 ϕ.

Figure 3:
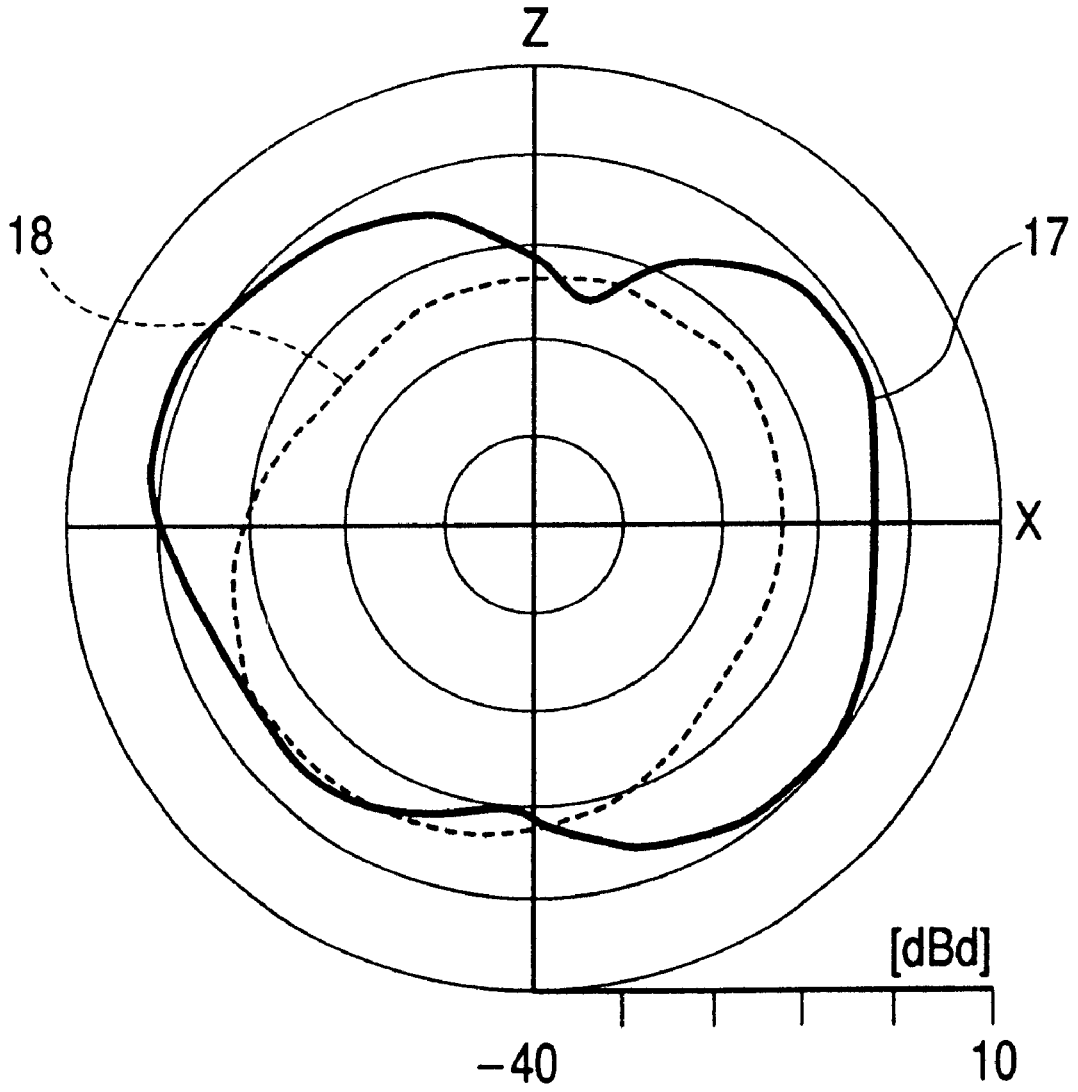
FIG. 3 is a graphical drawing showing directivity on the vertical XZ plane of the antenna apparatus shown in FIG. 1.

FIG. 3 is a graphical drawing showing directivity on the vertical XZ plane of the antenna apparatus shown in FIG. 1. The solid line 17 represents a vertically polarizing component and the chain line 18 represents a horizontally polarizing component.

Figure 17:
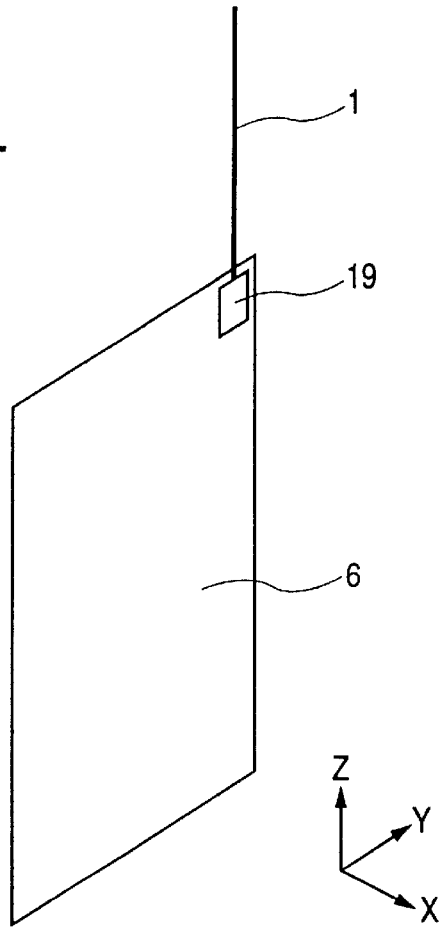
FIG. 17 PRIOR ART
FIG. 17 is a perspective view of a monopole antenna of a prior art.
Figure 18:
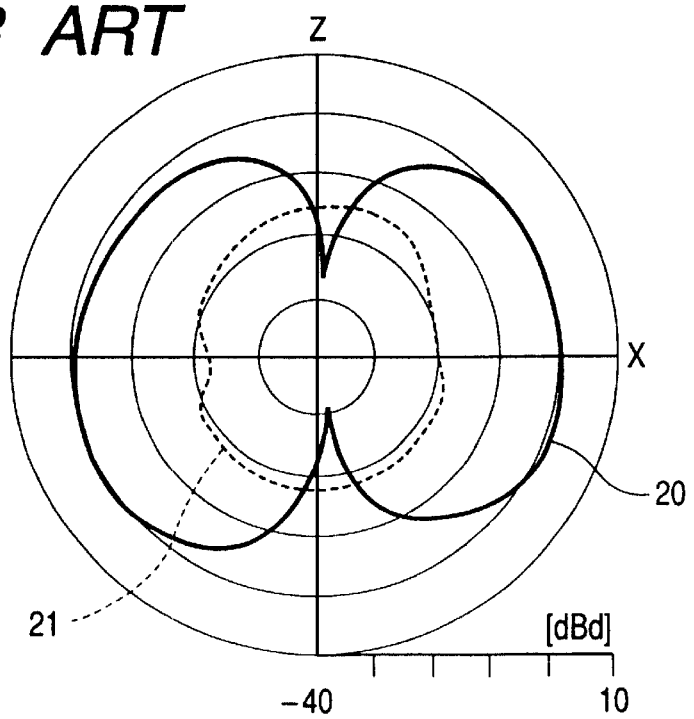
FIG. 18 PRIOR ART
FIG. 18 is a graphical drawing showing prior art directivity of the monopole antenna shown in FIG. 17 on the XZ plane.
Figure 20:
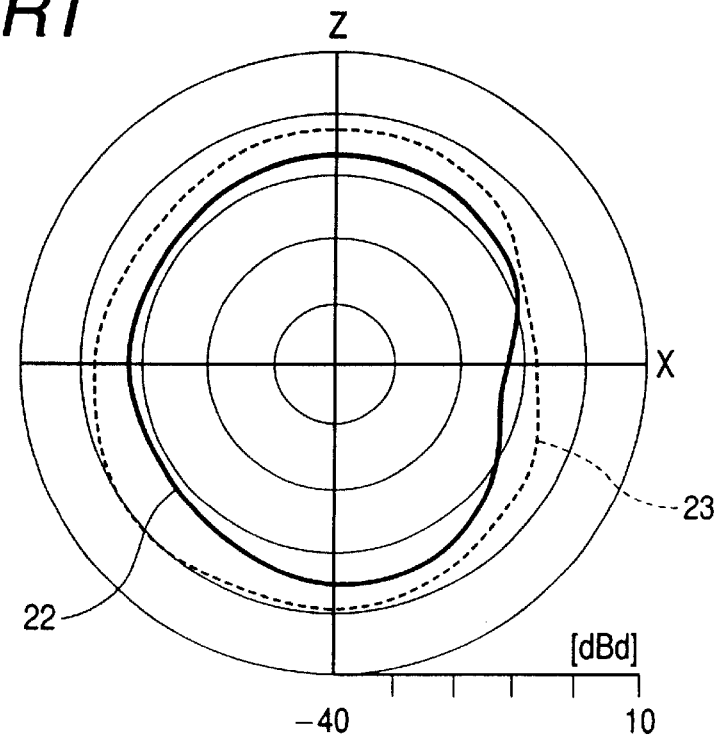
FIG. 20 PRIOR ART
FIG. 20 is a graphical drawing showing directivity of the prior art planer inverted-F antenna.

The directivities of the horizontal and vertical polarizing components shown in FIG. 3 are different from those in FIGS. 18 and 20. The averaged levels of the directivity of the horizontal polarizing component in the antenna apparatus of the first embodiment is higher than that shown in FIG. 18. This is because the antenna currents distributed in both of the monopole antenna 1 and the planer inverted-F antenna emit radio waves. Thus, the antenna current existing in the ground plane 6 is low, so that the radiation efficiency does not largely decrease when the hand holds the portable wireless communication apparatus including the antenna apparatus. Further, the horizontal polarizing component is higher than that shown in FIG. 17. Accordingly, the PAG during communication condition (FIGS. 21A to 21C) is about −5 dB.

As mentioned above, the antenna apparatus and the portable wireless communication apparatus according to the first embodiment, provides a high antenna characteristic in the communication condition without a matching circuit with a simple structure, that is, a monopole antenna 1 is connected to a point of a planer inverted-F antenna.

The length of the monopole antenna 1 is not limited to a half wavelength. That is, the length of the monopole antenna 1 can be varied as far as the impedance matching is provided.

<Second Embodiment>

Figure 4:
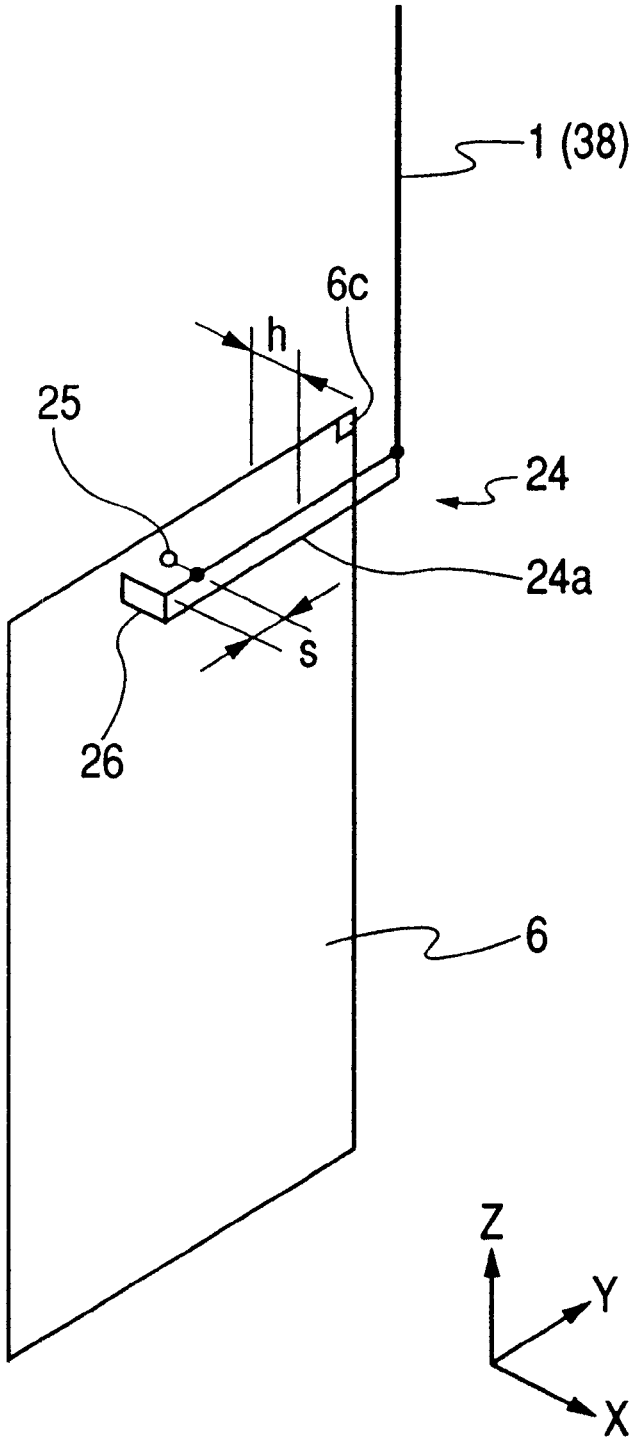
FIG. 4 is a perspective view of an antenna apparatus according to a second embodiment.

FIG. 4 is a perspective view of an antenna apparatus according to a second embodiment.

The antenna apparatus according to the second embodiment is substantially the same as that of the first embodiment. The difference is that an inverted-F antenna 24 replaces the planer inverted-F antenna 2.

As shown in FIG. 4, the inverted-F antenna 24 includes a conductor plate 24*a* having a length of about a quarter wavelength (37.5 mm) and a width of 2 mm. The inverted-F antenna 24 is arranged above the ground plane 6 along an edge of the ground plane 6 having a rectangular shape. The distance between the inverted-F antenna 24 and the ground plane 6 is 5 mm for example. One end of the inverted-F antenna 24 is connected to the ground plane 6 through a shorting portion 26. The other end of the inverted-F antenna 24 is connected to one end of the monopole antenna 1. The monopole antenna 1 is perpendicularly arranged to the longitudinal direction of the inverted-F antenna 24.

As shown in FIG. 4, the inverted-F antenna 24 is arranged on the horizontal plane (XY), so that the horizontal polarizing component is mainly radiated. Thus, the horizontal component level in the directivity according to the second embodiment is higher than that of the first embodiment. That is, the PAG during communication is about −4 dB which is relatively high.

In this embodiment, the ground plane 6 has a rectangular shape. However, only the corner 6*c* under the inverted-F antenna may be at right angles.

<Third Embodiment>

Figure 5A:
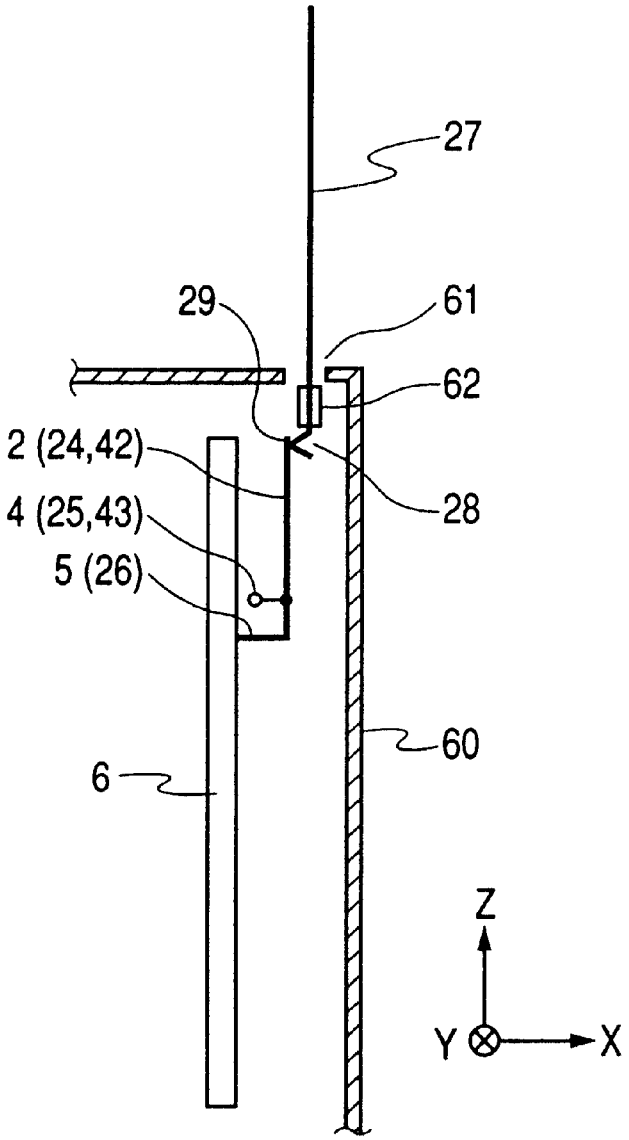
FIGS. 5A and 5B are side cross-sectional views of a portable wireless communication apparatus including the antenna apparatus according to a third embodiment.
Figure 5B:
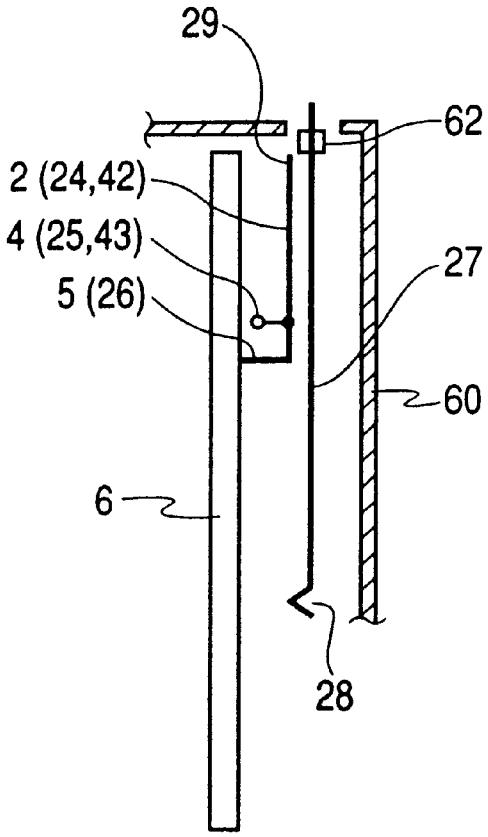

FIGS. 5A and 5B show side cross-sectional views of a portable wireless communication apparatus including the antenna apparatus according to a third embodiment. The antenna apparatus according to the third embodiment has substantially the same structure as that of the first embodiment. The difference is as follows:

The lower end (in the drawing) of the monopole antenna 27 has a contact 28 for electrically connecting the lower end to the end (corner) of the planer inverted-F antenna 2. A slidingly supporting member 62 supports the monopole antenna 27 with a sliding action. A housing 60 contains the planer inverted-F antenna 2, the ground plane 6, and the monopole antenna 27 and has a through hole for extending the monopole antenna 27 from the housing 60.

When the monopole antenna 27 is extended from the housing 60 the contact 28 electrically connects the monopole antenna 27 to the end of the planer inverted-F antenna 2. In this condition, the antenna apparatus according to the third embodiment operates in the same way as that of the first embodiment.

When the monopole antenna 27 is substantially contained in the housing 60, the contact 28 does not contact with one end of the planer inverted-F antenna 27, so that only the planer inverted-F antenna 2 operates. Thus, the user can select the receiving mode with extending and containing the monopole antenna.

The position with which the contact 28 contacts is determined in accordance with the impedance matching between the monopole antenna 27 and the inverted-F antenna 2.

Moreover, the planer inverted-F antenna 2 can be replaced with the inverted-F antenna 24 shown in FIG. 4 as shown by the reference in the parentheses in FIGS. 5A and 5B.

<Fourth Embodiment>

Figure 6:
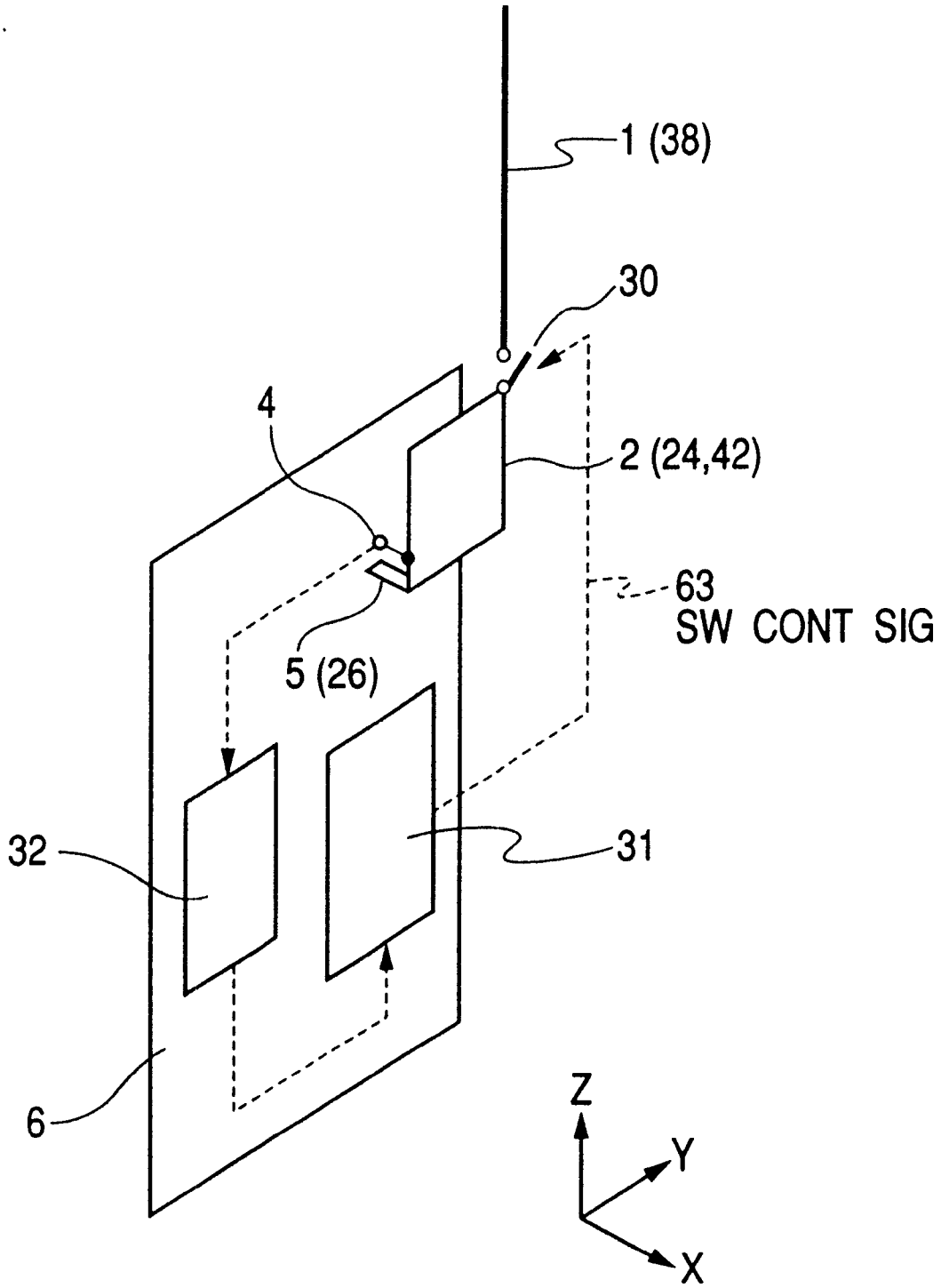
FIG. 6 is a perspective view of an antenna apparatus according to a fourth embodiment.

FIG. 6 is a perspective view of an antenna apparatus according to a fourth embodiment. The structure of the antenna apparatus according to the fourth embodiment has substantially the same structure as that of the first embodiment. The difference is that a high frequency switch 30 is further provided between the corner of the planer inverted-F antenna 2 and the end of the monopole antenna 1.

The high frequency switch 30 comprises a PIN diode which electrically connects the monopole antenna 1 to and disconnects the monopole antenna 1 from the planer inverted-F antenna 2 at a high frequency (operation frequency).

The high frequency switch is controlled in response to a switching control signal 63 generated by a control circuit 31. The feeding portion 4 supplies the reception signal to the receiving circuit 32 and the control circuit 31 detects a level of the reception signal and generates the switching control signal 63 in accordance with the detection level such that the level of the reception signal is kept high.

When the high frequency switch 30 is closed, the antenna apparatus of the forth embodiment acts as a complex antenna including the monopole antenna 1 and the planer inverted-F antenna 2 with the directivity shown in FIG. 3.

When the high frequency switch 30 is opened, the planer inverted-F antenna 2 operates as a single antenna and provides the directivity which is different from that shown in FIG. 3. The high frequency switch 30 is controlled such that the reception level is kept high, so that the directivity diversity operation is provided.

This diversity operation may be controlled in accordance with upward line transmission quality data transmitted from the base station in the area. That is, the base station detects the upward line transmission quality in accordance with the level or the like of the reception level from this portable wireless communication apparatus and generates the upward line transmission quality data in accordance with the detected level. The control circuit 31 receives the upward line transmission quality data and generates the switching control signal 63.

The planer inverted-F antenna 2 can be replaced with the inverted-F antenna 24.

As mentioned above, the antenna apparatus according to the fourth embodiment provides a directivity diversity operation with the high frequency switch 30.

<Fifth Embodiment>

Figure 7:
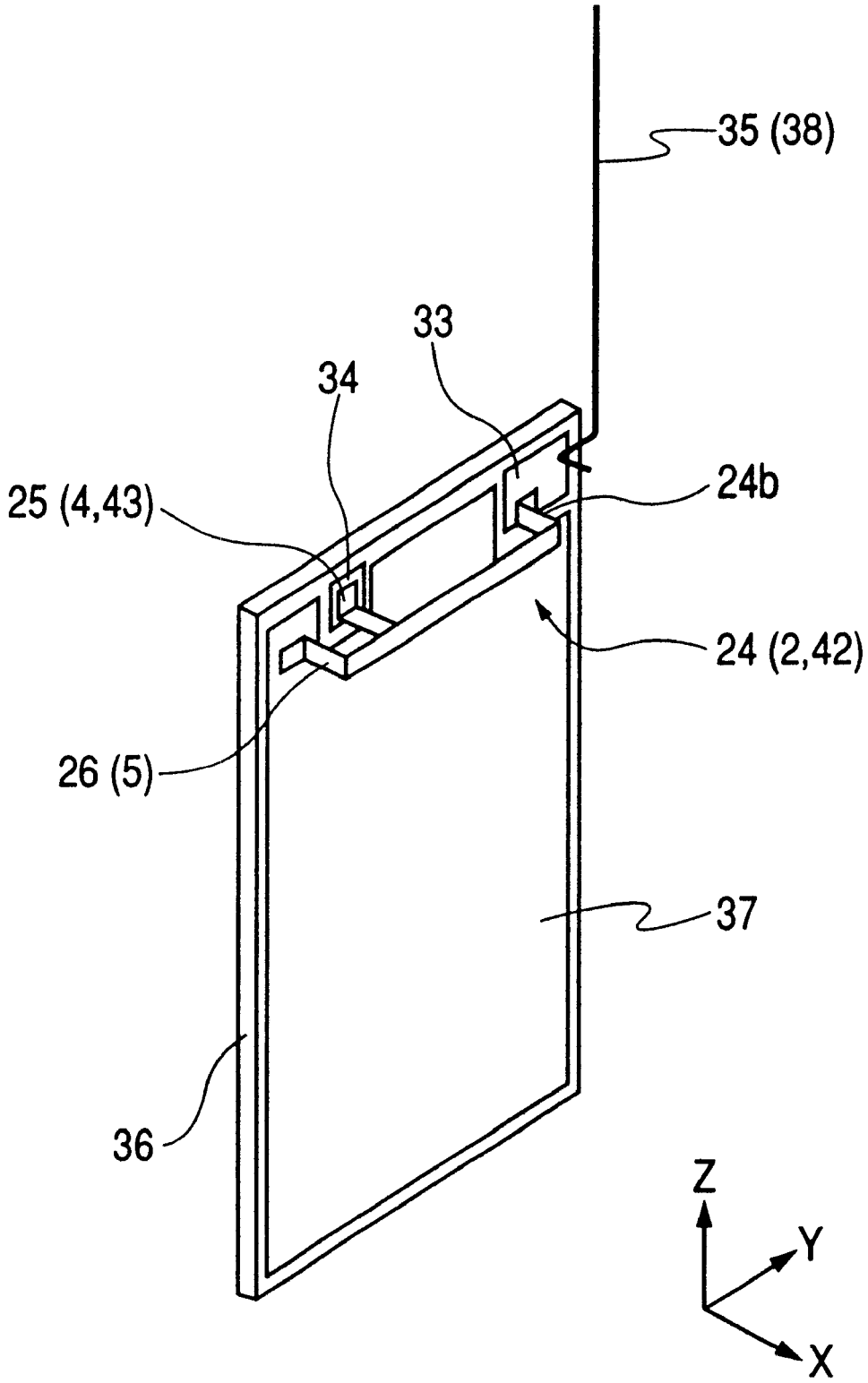
FIG. 7 is a perspective view of an antenna apparatus according to a fifth embodiment.

FIG. 7 is a perspective view of an antenna apparatus according to a fifth embodiment. The antenna apparatus according to the fifth embodiment has substantially the same structure as that of the second embodiment. The difference is that the inverted-F antenna 24 is provided on a printed circuit board 36. The end of the monopole antenna 35 is connected to or contacted to a round 33. The end of the inverted-F antenna 24 is connected to the round 33 by soldering through a conductor 24*b*. The feeding portion 25 is connected to a round 34 on the printed circuit board 36 by soldering. The other end of the inverted-F antenna 24 is connected to the ground plane 37 with the shorting portion 26.

The antenna apparatus shown in FIG. 7 operates as same as that of the second embodiment.

In manufacturing, the inverted-F antenna 24 is soldered and then, the monopole antenna 35 is attached such that the end of the monopole antenna contacts to the round 33, so that the junction structure between the inverted-F antenna 24 and the monopole antenna 35 can be simplified to improve the efficiency of manufacturing.

Moreover, the high frequency switch 30 in the fourth embodiment may be provided between the monopole antenna 35 and the inverted-F antenna 24 by adding a round (not shown).

<Sixth Embodiment>

Figure 8:
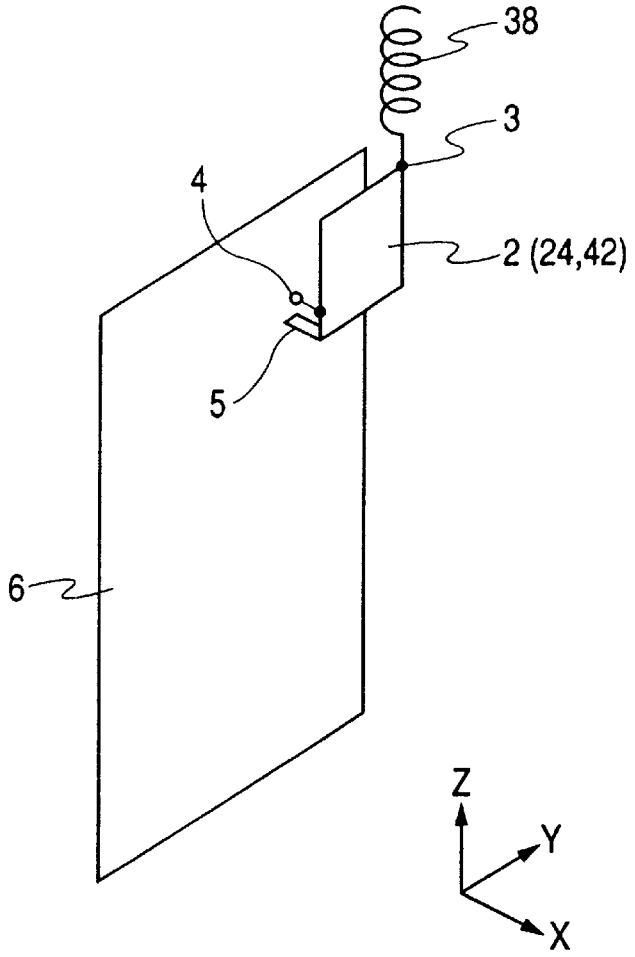
FIG. 8 is a perspective view of an antenna apparatus according to a sixth embodiment.

FIG. 8 is a perspective view of an antenna apparatus according to a sixth embodiment. The antenna apparatus according to the sixth embodiment has substantially the same structure as that of the first embodiment shown in FIG. 1. The difference is that a helical antenna 38 replaces the monopole antenna 1. That is, the helical antenna 38 acts as a monopole element. The helical antenna 38 operates in the normal mode (axial mode). For example, the height is 10 mm and the diameter of the helical is about 5 mm. The helical antenna 38 is electrically connected to the planer inverted-F antenna 2 at the junction point 3. The impedance of the helical antenna 38 at the junction point is equalized to that of the half wave monopole antenna.

This antenna apparatus shows directivity substantially the same as that of the antenna apparatus of the first embodiment shown in FIG. 1. Moreover, the height of the helical antenna 38 is about 10 mm at the operation frequency, so that the size of the antenna apparatus of this embodiment can be reduced. Moreover, the planer inverted-F antenna 2 can be replaced with the inverted-F antenna 24 as shown in FIG. 8.

<Seventh Embodiment>

Figure 9:
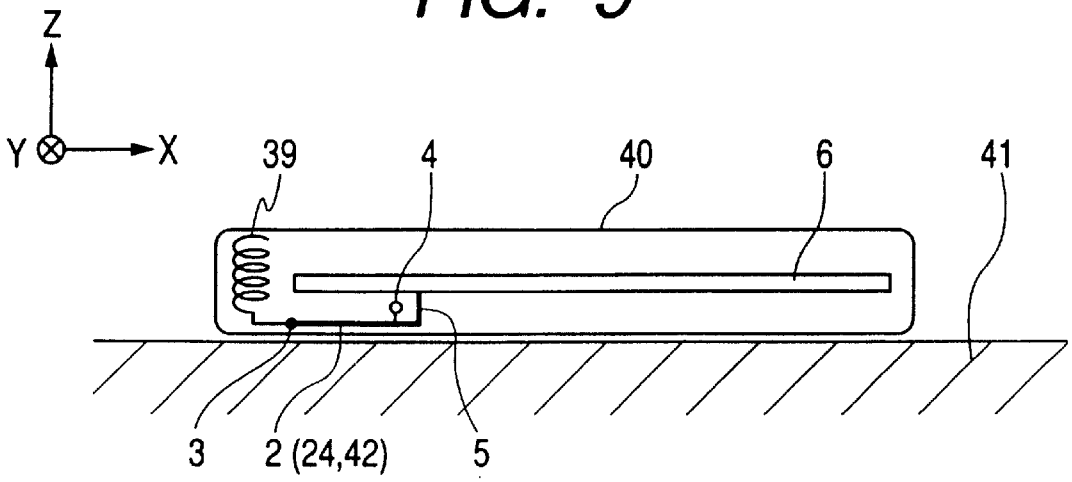
FIG. 9 is a side cross-sectional view of a portable wireless communication apparatus including an antenna apparatus according to a seventh embodiment.

FIG. 9 is a side cross-sectional view of a portable wireless communication apparatus including an antenna apparatus according to a seventh embodiment. The antenna apparatus according to the seventh embodiment has substantially the same structure as that of the sixth embodiment. The difference is that the helical antenna 39 is arranged along the shortest side of the parallelepiped housing 40 (thickness direction of the housing) or the helical antenna 39 is arranged in the perpendicular direction of the plane of the ground plane 6.

In operation, if the helical antenna 39 is inexistent and the radio wave is received or transmitted by only the planer inverted-F antenna 2, the planer inverted-F antenna 2 is extremely close to a metal table 41, so that electrical interaction between the planer inverted-F antenna 2 and the metal table 41 decreases the antenna characteristic. In this case, the PAG decreases by about −20 dB for example.

On the other hand, in the antenna apparatus of this embodiment, the helical antenna 39 is arranged in the direction perpendicular to the ground plane 6 and the surface of the metal table 41. Then, the helical antenna 39 operates the normal mode and shows a high radiation characteristic, so that the PAG is improved up to −13 dB.

<Eighth Embodiment>

Figure 10:
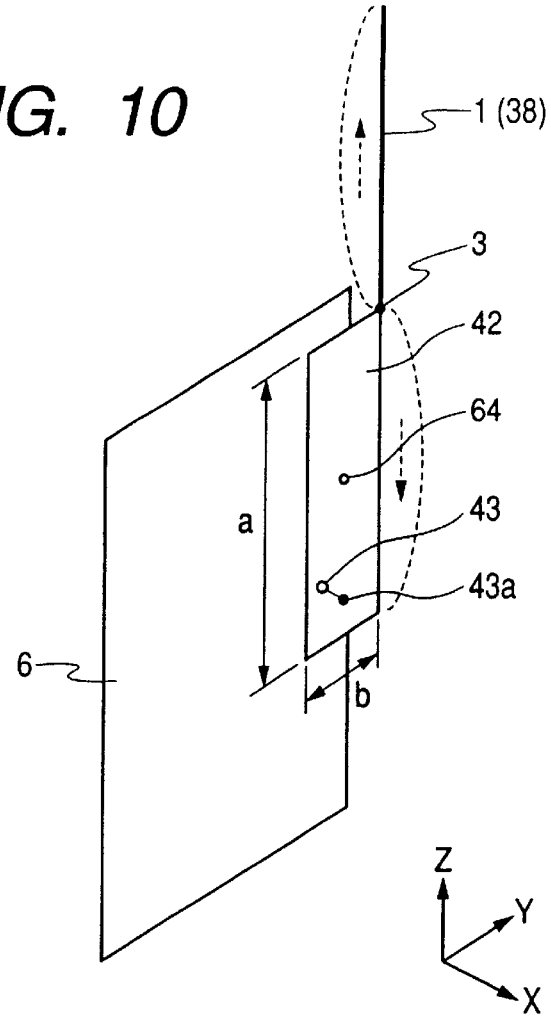
FIG. 10 is a perspective view of an antenna apparatus according to an eighth embodiment.

FIG. 10 is a perspective view of an antenna apparatus according to an eighth embodiment.

The antenna apparatus according to the eighth embodiment has substantially the same structure as that of the first embodiment. That is, the monopole antenna 1 is connected to a microstrip antenna 42 which adjusts the input impedance with the position of the feed point 43*a* and operates as the complex antenna with the monopole antenna 1. In other words, the planer inverted-F antenna 2 is replaced with the microstrip line 42.

The microstrip antenna 42 has a length a of about a half wave length (75 mm) and a width b of about 15 mm. One end of the microstrip antenna 42 is connected to one end of the monopole antenna 1 at the junction point 3. The feeding portion 43 is connected to a feed point 43*a* a predetermined distance apart from the junction point 3. Moreover, the input impedance is adjusted in accordance with a distance between the feed point 43*a* and a zero voltage point 64 where the voltage is zero at the micro strip line 43 but this point shows the maximum current.

In FIG. 10, chain lines and arrows show the current distribution of the half wavelength microstrip line 42 and the monopole antenna 1. The directivity of the complex antenna including the half wavelength microstrip antenna 42 and the monopole antenna 1 is different from that (FIG. 3) of the first embodiment (FIG. 1) and is biased in the Z direction and −Z direction. If the width b of the half wavelength microstrip antenna 42 is made wide, the bandwidth is broadened because the electrical volume of the antenna becomes large. For example, the planer inverted-F antenna 2 shown in FIG. 1 has a bandwidth of 100 MHz (bandwidth ratio is 5%). On the other hand, the bandwidth of the half wavelength micro strip antenna 42 is about 150 MHz (bandwidth ratio is 7.5%).

As mentioned above, connecting the monopole antenna 1 to the half wavelength microstrip antenna 42 provides the antenna apparatus according to the eighth embodiment, so that a high antenna characteristic is provided and a broad bandwidth is also provided.

The microstrip antenna 42 can be used in the previous embodiments. That is, the microstrip antenna 42 can replace the planer inverted-F antenna 2 in the third embodiment shown in FIGS. 5A and 5B. Moreover, the microstrip antenna 42 can replace the planer inverted-F antenna 2 in the fourth embodiment shown in FIG. 6, the inverted-F antenna 24 in the fifth embodiment shown in FIG. 7, the planer inverted-F antenna 2 in the sixth embodiment shown in FIG. 8.

<Ninth Embodiment>

Figure 11:
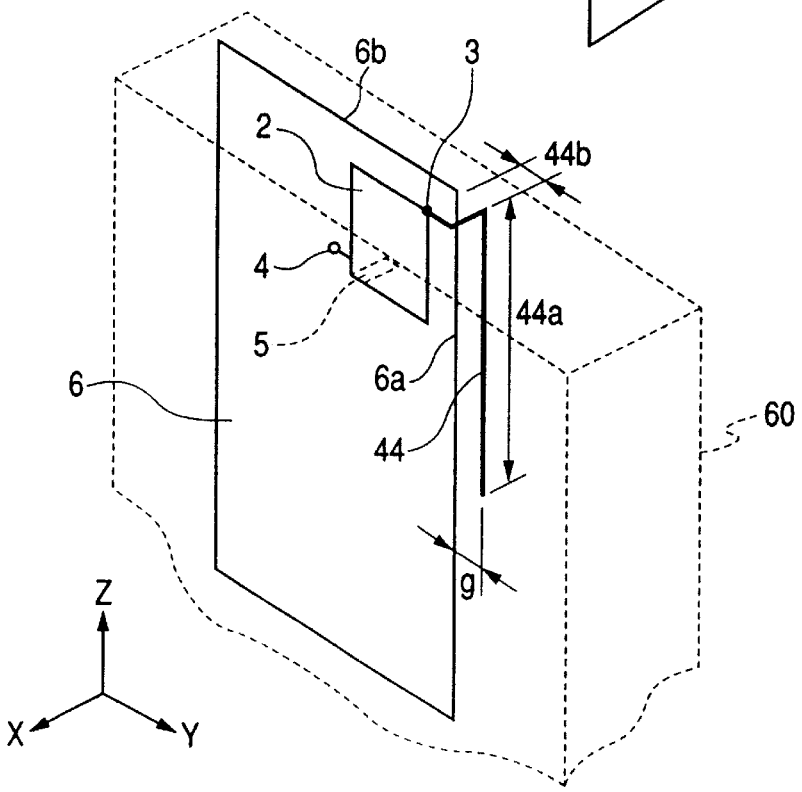
FIG. 11 is a perspective view of an antenna apparatus according to a ninth embodiment.

FIG. 11 is a perspective view of an antenna apparatus according to a ninth embodiment. The antenna apparatus according to the ninth embodiment has substantially the same structure as that of the first embodiment. The difference is that the folded monopole antenna 44 replaces the monopole antenna 1.

The folded monopole antenna 44 has a half wavelength (75 mm) and one end thereof is connected to the planer inverted-F antenna 2 at the junction point 3. The first portion 44*a* of the folded monopole antenna 44 is arranged along an (straight) edge 6*a* of the ground plane 6 having a rectangular shape. The second portion 44*b* of the monopole antenna 44 is arranged along the neighboring edge 6*b* of the ground plane 6, wherein the first portion 44*a* and the second portion 44*b* have a perpendicular relation. The distance g between the first portion 44*a* of the monopole antenna 44 and the edge 6*a* of the ground plane 6 is about 5 mm. The monopole antenna 44 is contained in the housing 60.

Figure 12:
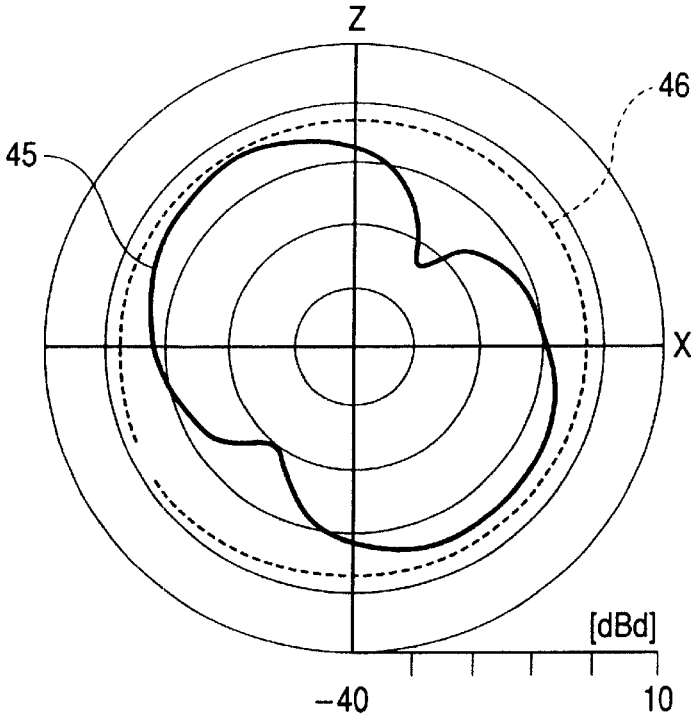
FIG. 12 is a graphical drawing showing directivity of the antenna apparatus shown in FIG. 11 on the vertical XZ plane.

FIG. 12 is a graphical drawing showing directivity of the antenna apparatus shown in FIG. 11 on the vertical XZ plane. In FIG. 12, the solid line represents the vertical polarizing component 45 and the chain line represents the horizontal polarizing component 46. The averaged level of the vertical polarizing component is improved from the directivity of only the planer inverted-F antenna 2 and thus, radiation in the horizontal plane (XY plane) is increased.

Figure 21A:
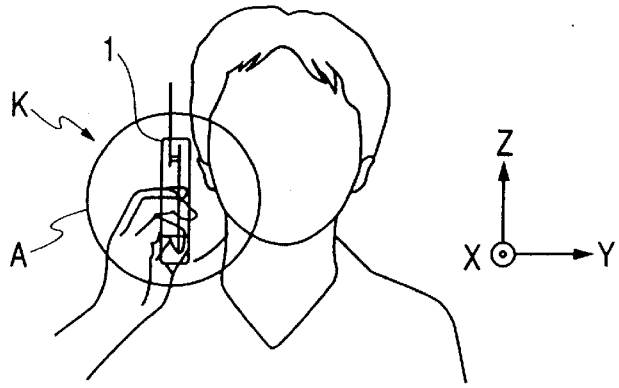
FIG. 21A PRIOR ART
FIGS. 21A to 21C are prior art illustrations showing using conditions of a portable wireless communication apparatus.
Figure 21B:
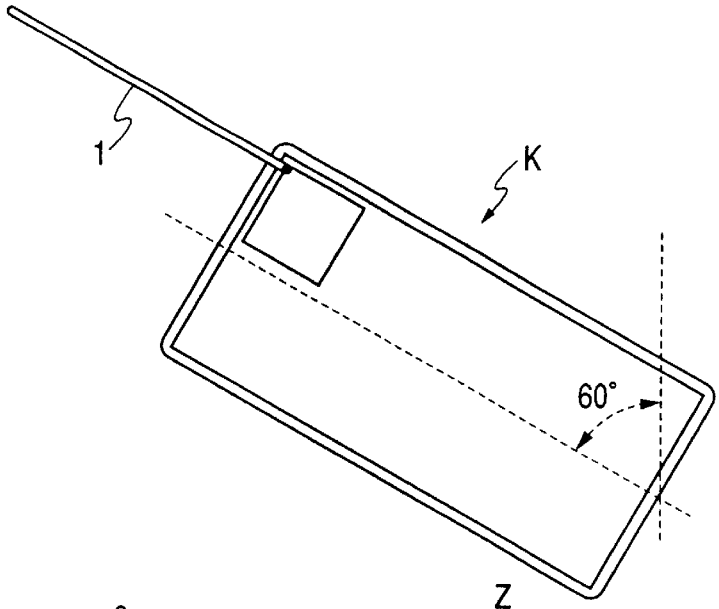
FIG. 21B PRIOR ART
Figure 21C:
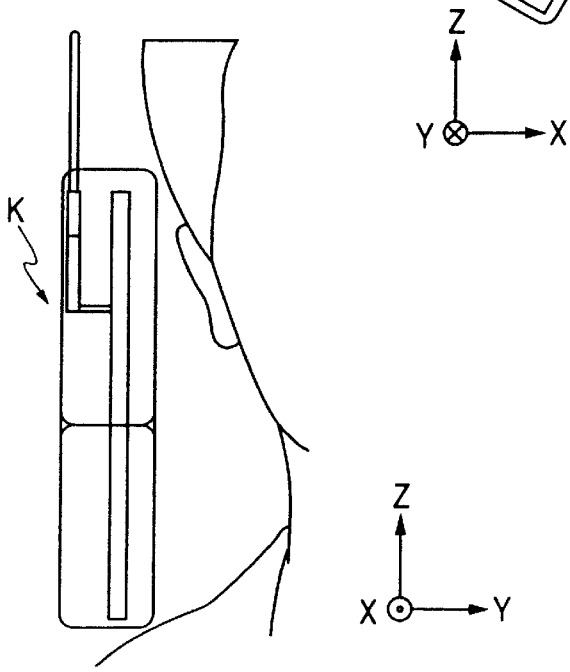
FIG. 21C PRIOR ART

In the communication condition as shown in FIGS. 21A to 21C with this antenna apparatus, the folded monopole antenna 44 may be near the head of the user. However, the antenna apparatus is arranged on the opposite side of the speaker, so that this arrangement eliminates the influence to the radiation characteristic of the antenna apparatus by the human body.

Figure 19:
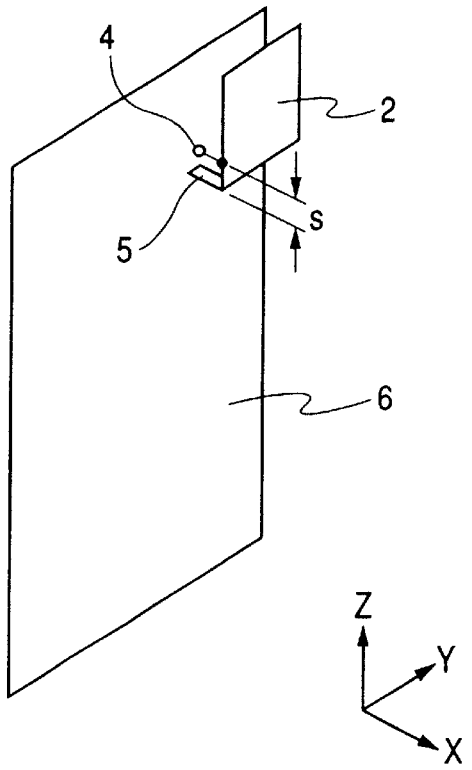
FIG. 19 PRIOR ART
FIG. 19 is another prior antenna apparatus.

If the antenna apparatus is used in a wireless data terminal as the portable wireless communication apparatus, a user holds the wireless data terminal in a breast pocket for example. The orientation of the housing of the wireless data terminal is not constant. That is, either the inverted-F antenna is close to the human body or the other side is close to the human body in the case of the prior art shown in FIG. 19. If the inverted-F antenna is close to the human body, the PAG is about −8 dB.

On the other hand, the PAG of the antenna apparatus shown in FIG. 11 is improved because the folded monopole antenna 44 is not close to the human body irrespective of the direction of the housing. Thus, the PAG of the wireless data terminal is about −6 dB, so the antenna apparatus according to the ninth embodiment is favorable for the wireless data terminal. This embodiment is applicable to the fifth embodiment shown in FIG. 7. That is, the monopole antenna 44 may replace the monopole antenna 35 (38).

<Tenth Embodiment>

Figure 13:
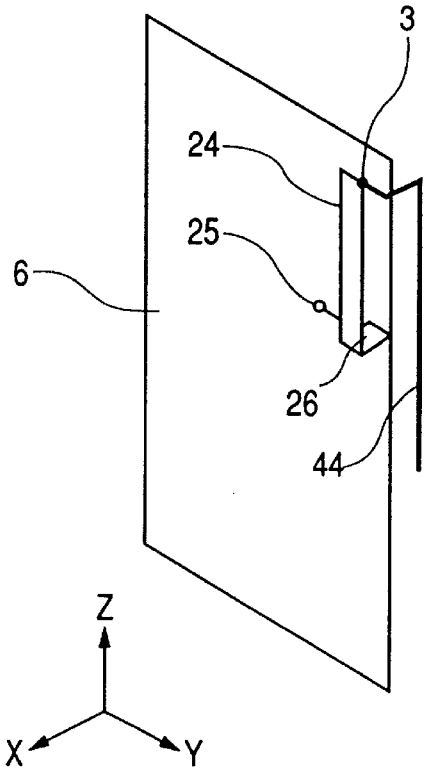
FIG. 13 is a perspective view of an antenna apparatus according to a tenth embodiment.

FIG. 13 is a perspective view of an antenna apparatus according to a tenth embodiment. The antenna apparatus according to the tenth embodiment has substantially the same structure as that of the ninth embodiment. The difference is that the inverted-F antenna 24 replaces the planer inverted-F antenna 2.

Figure 14:
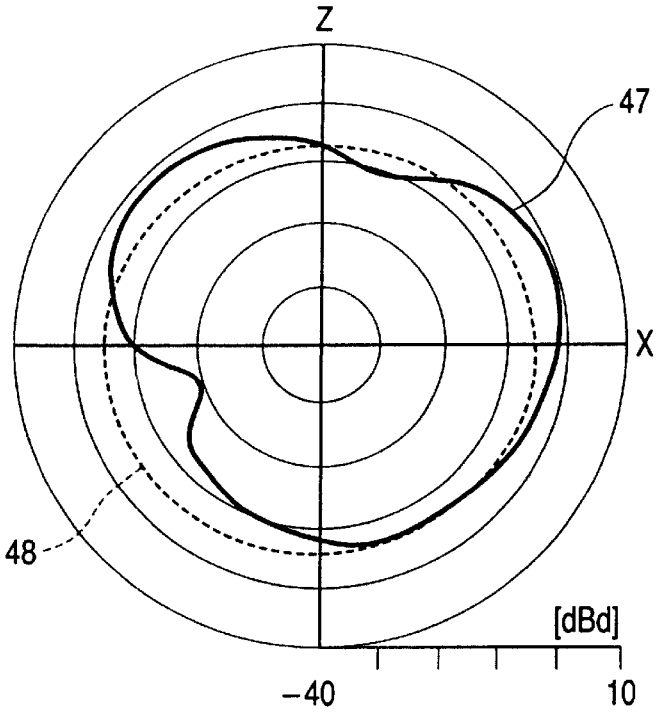
FIG. 14 is a graphical drawing showing directivity of the antenna apparatus shown in FIG. 13 on the vertical XZ plane.

FIG. 14 is a graphical drawing showing directivity of the antenna apparatus shown in FIG. 13 on the vertical XZ plane. In FIG. 14, the solid line represents the vertical polarizing component 47 and the chain line represents the horizontal polarizing component 48. The averaged level of the vertical polarizing component is improved from the directivity of only the planer inverted-F antenna 24 and thus, radiation in the horizontal plane (XY plane) is increased.

In the communication condition as shown in FIG. 21 with this antenna apparatus, the folded monopole antenna 44 may be near the head of the user. However, because the antenna apparatus is arranged on the opposite side of the speaker, this arrangement eliminates the influence to the radiation characteristic of the antenna apparatus by the human body.

If the antenna apparatus is used in a wireless data terminal as the portable wireless communication apparatus, a user holds the wireless data terminal in a breast pocket for example. The orientation of the housing of the wireless data terminal is not constant. That is, either the inverted-F antenna is close to the human body or the other side is close to the human body. If the inverted-F antenna is close to the human body, the PAG is about −8 dB.

Contrarily, the PAG of the antenna apparatus shown in FIG. 13 is improved because the folded monopole antenna 44 is not close to the human body irrespective of the direction of the housing. Thus, the PAG when the wireless data terminal is about −4 dB, so the antenna apparatus according to the ninth embodiment is favorable for the wireless data terminal.

<Eleventh Embodiment>

Figure 15:
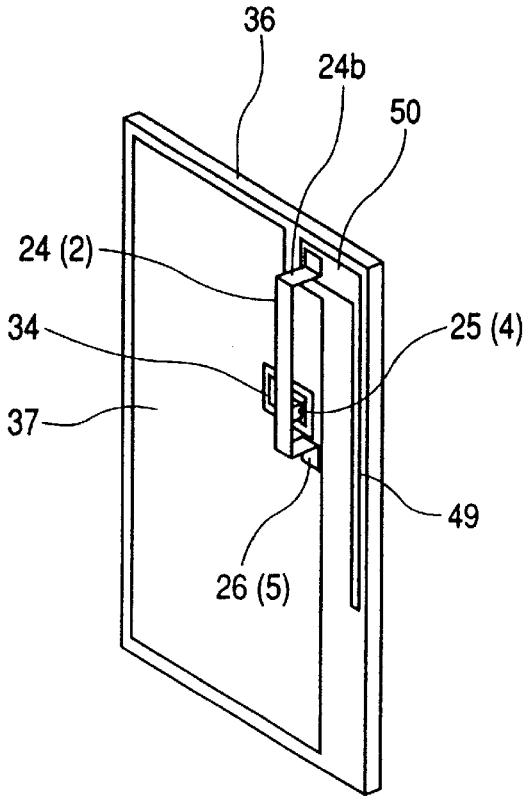
FIG. 15 is a perspective view of an antenna apparatus according an eleventh embodiment.

FIG. 15 is a perspective view of an antenna apparatus according an eleventh embodiment. The structure of the antenna apparatus according to the eleventh embodiment has substantially the same as that of the tenth embodiment. The difference is that the folded monopole antenna 49 is formed on a printed circuit board 36. The monopole antenna 49 having a half wavelength is formed on the printed circuit board 36 and one end of the inverted-F antenna 24 is connected to or contact with a junction round 50. The round 50 is connected to the monopole antenna 49. The other end of the inverted-F antenna 24 is connected to a ground plane 37 formed on the printed circuit board 36.

In manufacturing, the monopole antenna 49, the ground plane 37, and a feeding portion 25 are formed on the printed circuit board 36. Then, the inverted-F antenna 24 is mounted on the printed circuit board 36 as shown in FIG. 15. Thus, the manufacturing process is simplified.

Moreover, the planer inverted-F antenna 2 may replace the inverted-F antenna 24.

<Twelfth Embodiment>

Figure 16A:
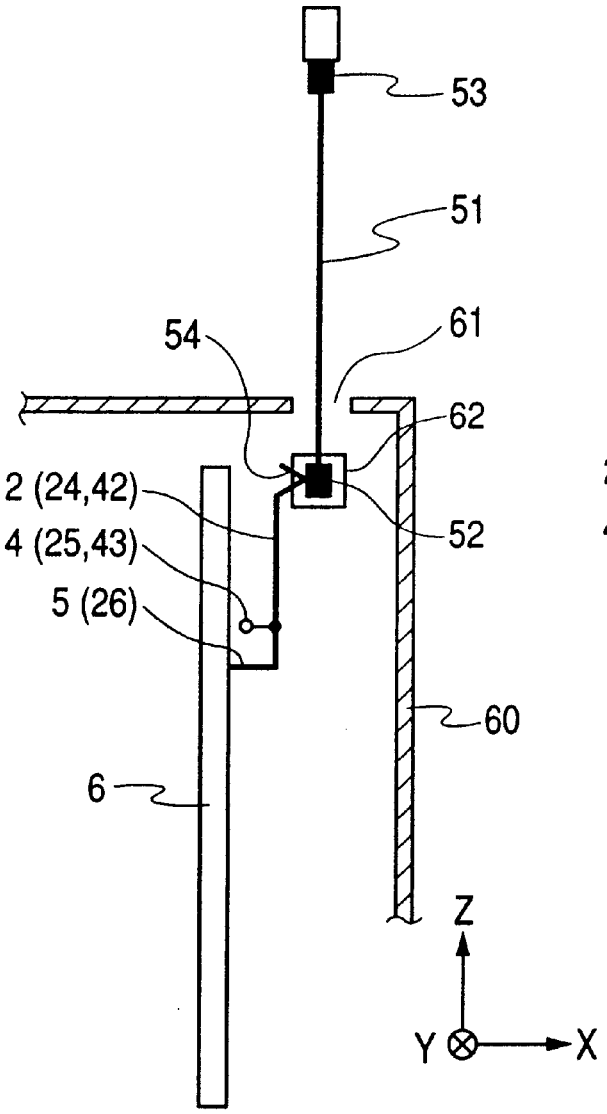
FIGS. 16A and 16B are cross-sectional views of an antenna apparatus according to a twelfth embodiment.
Figure 16B:
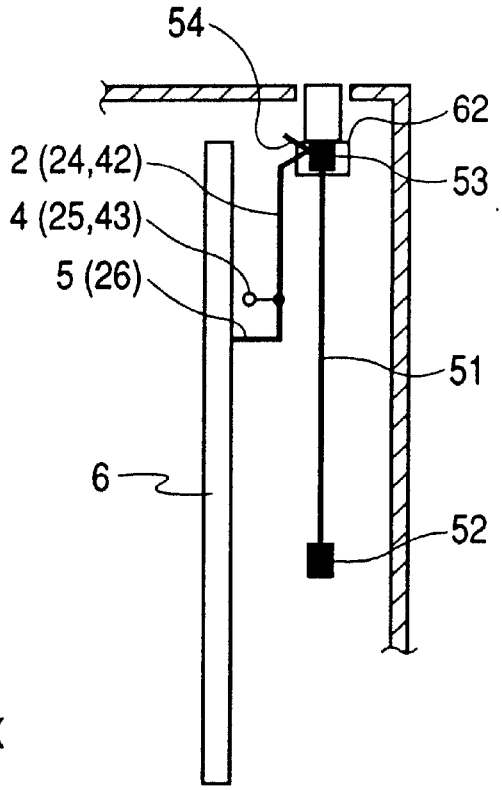

FIGS. 16A and 16B are cross-sectional views of an antenna apparatus according to a twelfth embodiment. The antenna apparatus according to the twelfth embodiment has substantially the same as that of the third embodiment shown in FIGS. 5A and 5B. The difference is that the contact 54 further contacts with a contact 53 at the upper end of the monopole antenna 51.

The monopole antenna 51 has a half wavelength and has a contact 52 at the lower end (in the drawing) and the contact 53 at the upper end. When the monopole antenna 51 is extended from the housing 60 through a through hole 61, the contact 52 couples the planer inverted-F antenna 2 to the monopole antenna 51, so the antenna apparatus according to the twelfth embodiment operates in the same manner as the antenna apparatus according to the first embodiment (FIG. 1). Thus, a high PAG is provided.

When the monopole antenna 54 is contained in the housing 60, the contact 53 contacts with the contact 54 of the planer inverted-F antenna 2. Then, the antenna apparatus in this condition operates in the same as that shown in FIG. 11. Thus, if the portable wireless communication apparatus including the antenna apparatus according to this embodiment is held in a breast pocket, a high PAG is provided.

As mentioned above, the monopole antenna 51 is connected to the planer inverted-F antenna 2 in the same manner as that shown in FIG. 1 when the monopole antenna 51 is extended. Further, the monopole antenna 51 is connected to the planer inverted-F antenna 2 in the same manner as that shown in FIG. 11 when the monopole antenna 51 is pushed in the housing 60, so that the antenna characteristic is automatically changed in accordance with the used condition (position).

The inverted-F antenna 24 may replace the planer inverted-F antenna 2. The microstrip antenna 42 may replace the planer inverted-F antenna 2.

In the above-mentioned embodiments, the planer inverted-F antenna 2, the inverted-F antenna 24, and the half wavelength microstrip antenna can be provided with a printed pattern formed on a dielectric substrate.

As mentioned above, the antenna apparatus according to the present invention, one end of the monopole antenna having a wavelength corresponding of the operation frequency is connected to a point of microstrip antenna having a size corresponding to the operation frequency above the ground plane. The feeding point is adjusted against the zero voltage point to provide the desired input impedance. The complex antenna including the monopole antenna and the microstrip (inverted-F) antenna shows a suitable directivity and transmission efficiency.

In the above-mentioned embodiments, the helical antenna 38 may replace with the monopole antenna 1 shown in FIGS. 1, 4, 6, 7, and 10.

What is claimed is:

1. An antenna apparatus comprising:

a microstrip antenna above a ground plane, having a size predetermined by an operation frequency of said antenna apparatus; and a monopole element having a length predetermined by said operation frequency, one end of said monopole element being electrically connected to a point of said microstrip antenna, said microstrip antenna having a feed point at a predetermined distance from said point, wherein said point is for operating said microstrip antenna as a matching circuit for said monopole element and as a portion of an emission element to form a complex antenna of said microstrip antenna and said monopole element.

2. The antenna apparatus as claimed in claim 1, wherein said microstrip antenna comprises an inverted-F antenna including a short conductor for grounding at a distance from said feed point substantially at a corner diagonally opposite said point.

3. The antenna apparatus as claimed in claim 1, wherein said monopole element comprises a monopole antenna.

4. The antenna apparatus as claimed in claim 3, further comprising:

slidingly supporting means for slidingly supporting said monopole antenna;

switch means; and a housing having a through hole and containing said inverted-F antenna, said monopole antenna, said switch means and said slidingly supporting means, wherein said switch means is for electrically connecting said one end to said point when said monopole antenna is extended from said housing through said through connects said one end to said point when said monopole antenna is hole by slidingly supporting means and electrically disconnecting said one end from said point when said monopole antenna is substantially retracted into said housing by said slidingly supporting means.

5. The antenna apparatus as claimed in claim 3, further comprising slidingly supporting means for slidingly supporting said monopole antenna;

switch means; and a housing having a through hole and containing said inverted-F antenna, said monopole antenna, said switch means and said slidingly supporting means, wherein said switch means is for electrically connecting said one end to said point when said monopole antenna is extended from said housing through said through hole by said slidingly supporting means and electrically connecting the other end of said monopole antenna when said monopole antenna is substantially retracted into said housing by said slidingly supporting means.

6. The antenna apparatus as claimed in claim 3, further comprising:

switch means for electrically connecting and disconnecting said one end to and from said point to provide diversity operation between said inverted-F antenna and a complex antenna including said inverted-F antenna and the monopole antenna in response to a switch control signal.

7. The antenna apparatus as claimed in claim 6, further comprising communication condition detection means for detecting a communication condition using said antenna apparatus for generating said switch control signal in accordance with said communication condition.

8. The antenna apparatus as claimed in claim 3, further comprising a printed circuit board having a printed pattern for coupling said point to said one end.

9. The antenna apparatus as claimed in claim 3, wherein at least a tip of said monopole antenna is located along a straight edge of said ground plane at a predetermined distance from said ground plane.

10. The antenna apparatus as claimed in claim 3, further comprising a printed circuit board, said printed circuit board having said monopole antenna thereon.

11. The antenna apparatus as claimed in claim 2, wherein said monopole element comprises a helical antenna.

12. The antenna apparatus as claimed in claim 11, further comprising a housing having a substantially parallelepiped shape for containing said inverted-F antenna and said helical antenna, wherein said helical antenna is located along the shortest side of said parallelepiped shape.

13. The antenna apparatus as claimed in claim 1, wherein said microstrip antenna comprises a planer inverted-F antenna including a short conductor for grounding at a distance from said feed point substantially at a corner diagonally opposite said point.

14. The antenna apparatus as claimed in claim 13, wherein said monopole element comprises a monopole antenna.

15. The antenna apparatus as claimed in claim 14, further comprising:

slidingly supporting means for slidingly supporting said monopole antenna;

switch means; and a housing having a through hole and containing said inverted-F antenna, said monopole antenna, said switch means and said slidingly supporting means, wherein said switch means is for electrically connecting said one end to said point when said monopole antenna is extended from said housing through said through hole by said slidingly supporting means and electrically disconnecting said one end from said point when said monopole antenna is substantially retracted into said housing by said slidingly supporting means.

16. The antenna apparatus as claimed in claim 14, further comprising: slidingly supporting means for slidingly supporting said monopole antenna;

switch means; and a housing having a through hole and containing said inverted-F antenna, said monopole antenna, said switch means and said slidingly supporting means, wherein said switch means is for electrically connecting said one end to said point when said monopole antenna is extended from said housing through said through hole by said slidingly supporting means and electrically connecting the other end of said monopole antenna when said monopole antenna is substantially retracted into said housing by said slidingly supporting means.

17. The antenna apparatus as claimed in claim 14, further comprising switch means for electrically connecting and disconnecting said one end to and from said point to provide diversity operation between said planar inverted-F antenna and a complex antenna including said planar inverted-F antenna and the monopole antenna in response to a switch control signal.

18. The antenna apparatus as claimed in claim 17, further comprising communication condition detection means for detecting a communication condition using said antenna apparatus for generating said switch control signal in accordance with said communication condition.

19. The antenna apparatus as claimed in claim 14, further comprising a printed circuit board having a printed pattern for coupling said point to said one end.

20. The antenna apparatus as claimed in claim 14, wherein at least a tip of said monopole antenna is located along a straight edge of said ground plane at a predetermined distance from said ground plane.

21. The antenna apparatus as claimed in claim 14, further comprising a printed circuit board, wherein said monopole antenna is formed on said printed circuit board.

22. The antenna apparatus as claimed in claim 13, wherein said monopole element comprises a helical antenna.

23. The antenna apparatus as claimed in claim 22, further comprising a housing having a substantially parallelepiped shape for containing said planer inverted-F antenna and said helical antenna, wherein said helical antenna is located along the shortest side of said parallelepiped shape.

24. The antenna apparatus as claimed in claim 1, wherein said size is a half wavelength.

25. The antenna apparatus as claimed in claim 24, wherein said monopole element comprises a monopole antenna.

26. The antenna apparatus as claimed in claim 25, further comprising:

slidingly supporting means for slidingly supporting said monopole antenna;

switch means; and a housing having a through hole and containing said microstrip antenna, said monopole antenna, said switch means and said slidingly supporting means, wherein said switch means is for electrically connecting said one end to said point when said monopole antenna is extended from said housing through said through hole by said slidingly supporting means and electrically disconnecting said one end from said point when said monopole antenna is substantially retracted into said housing by said slidingly supporting means.

27. The antenna apparatus as claimed in claim 25, further comprising:

slidingly supporting means for slidingly supporting said monopole antenna;

switch means; and a housing having a through hole and containing said microstrip antenna, said monopole antenna, said switch means and said slidingly supporting means, wherein said switch means is for electrically connecting said one end to said point when said monopole antenna is extended from said housing through said through hole by said slidingly supporting means and electrically disconnecting said one end from said point when said monopole antenna is substantially retracted into said housing by said slidingly supporting means.

28. The antenna apparatus as claimed in claim 25, further comprising switch means for electrically connecting and disconnecting said one end to and from said point to provide diversity operation between said planar inverted-F antenna and the monopole antenna in response to a switch control signal.

29. The antenna apparatus as claimed in claim 28, further comprising communication condition detection means for detecting a communication condition using said antenna apparatus for generating said switch control signal in accordance with said communication condition.

30. The antenna apparatus as claimed in claim 25, further comprising a printed circuit board having a printed pattern for coupling said point to said one end.

31. The antenna apparatus as claimed in claim 24, wherein said monopole element comprises a helical antenna.

32. The antenna apparatus as claimed in claim 31, further comprising a housing having a substantially parallelepiped shape for containing said planar inverted-F antenna and said helical antenna, wherein said helical antenna is located along the shortest side of said parallelepiped shape.

33. The antenna apparatus as claimed in claim 1, wherein a position of said feed point is defined by a distance from a zero voltage point at the microstrip antenna.

34. The antenna apparatus as claimed in claim 1, wherein said point substantially corresponds to a highest impedance of said microstrip antenna.

35. A portable wireless communication apparatus comprising:

a receiving and transmitting circuit;

an antenna apparatus including:

a microstrip antenna above a ground plane, having a size corresponding to an operation frequency of said antenna apparatus;

a monopole element having a length corresponding to said operation frequency, one end of said monopole element being electrically connected to a point of said microstrip antenna, said microstrip antenna having a feed point at a predetermined distance from said point;

receiving and transmission means for communicating with said antenna apparatus; and a housing for containing said receiving and transmission circuit and said antenna apparatus, wherein said point is determined to operate said microstrip antenna as a matching circuit for said monopole element and as a portion of an emission element to form a complex antenna of said microstrip antenna and said monopole element.

36. The portable wireless communication apparatus as claimed in claim 35, wherein said microstrip antenna comprises an inverted-F antenna including a short conductor for grounding at a distance from said feed point substantially at a corner diagonally opposite said point.

37. The portable wireless communication apparatus as claimed in claim 35, wherein said microstrip antenna comprises a planar inverted-F antenna including a short conductor for grounding at a distance from said feed point substantially at a corner diagonally opposite said point.

38. The portable wireless communication apparatus as claimed in claim 35, wherein said size is a half wavelength.

39. The portable wireless communication apparatus as claimed in claim 35, wherein said monopole element comprises a monopole antenna.

40. The portable wireless communication apparatus as claimed in claim 35, wherein said monopole element comprises a helical antenna.

* * * * *

UNITED STATES PATENT AND TRADEMARK OFFICE

CERTIFICATE OF CORRECTION

PATENT NO. : 6,452,558 B1 
DATED : September 17, 2002
INVENTOR(S) : Yutaka Saitou, Tomoaki Nishikido and Hiroshi Haruki It is certified that error appears in the above-identified patent and that said Letters Patent is hereby corrected as shown below:

Column 12,
Line 67, delete “con-”;

Column 13,
Line 1, delete in its entirety;
Line 2, delete “antenna is”.

Column 15,
Line 20, after “and” insert -- a complex antenna including said planar inverted-F antenna and --.

Signed and Sealed this

Twenty-second Day of July, 2003

JAMES E. ROGAN
*Director of the United States Patent and Trademark Office*